US011346255B2

(12) United States Patent
Ahlbom et al.

(10) Patent No.: US 11,346,255 B2
(45) Date of Patent: May 31, 2022

(54) METHOD AND CONTROLLER FOR PREVENTING FORMATION OF DROPLETS IN A HEAT EXCHANGER

(71) Applicant: CLIMEON AB, Kista (SE)

(72) Inventors: Esko Ahlbom, Uppsala (SE); Rikard Pettersson, Solna (SE)

(73) Assignee: CLIMEON AB, Kista (SE)

( * ) Notice: Subject to any disclaimer, the term of this patent is extended or adjusted under 35 U.S.C. 154(b) by 0 days.

(21) Appl. No.: 17/413,458

(22) PCT Filed: Dec. 10, 2019

(86) PCT No.: PCT/SE2019/051263

§ 371 (c)(1),
(2) Date: Jun. 11, 2021

(87) PCT Pub. No.: WO2020/122799

PCT Pub. Date: Jun. 18, 2020

(65) Prior Publication Data

US 2022/0034240 A1 Feb. 3, 2022

(30) Foreign Application Priority Data

Dec. 14, 2018 (SE) ..... 1851592-4

(51) Int. Cl.
*F01K 13/02* (2006.01)
*F28D 9/00* (2006.01)
(Continued)

(52) U.S. Cl.
CPC ..... *F01K 13/02* (2013.01); *F28D 9/005* (2013.01); *F28F 27/02* (2013.01); *F01K 13/003* (2013.01);
(Continued)

(58) Field of Classification Search
CPC ..... F01K 13/02; F01K 13/003; F25B 39/02; F25B 2600/21; F25B 2700/21172;
(Continued)

(56) References Cited

U.S. PATENT DOCUMENTS 6,505,475 B1 * 1/2003 Zugibe ..... F24F 11/30 62/192
6,560,981 B2 * 5/2003 Flynn ..... F25B 41/22 62/217
(Continued)

FOREIGN PATENT DOCUMENTS

EP 2674697 A1 12/2013
EP 2878912 A1 6/2015
(Continued)

OTHER PUBLICATIONS

SE542760 C2—Search Report dated Jun. 20, 2019, 2 pages.
WO2020122799 International Search Report and Written Opinion dated Jun. 18, 2020, 8 pages.

*Primary Examiner* — Ljiljana V. Ciric
(74) *Attorney, Agent, or Firm* — Haynes Beffel & Wolfeld LLP; Mark Haynes; Andrew Dunlap

(57) ABSTRACT

A method for preventing formation of droplets in a heat exchanger, in which a second medium transfers heat to a first. The method is performed by a controller which receives different temperature values ($T_1$, $T_2$, $T_3$) and a pressure (P) value to be used for calculating a boiling point temperature value ($T_B$) and determining a first temperature difference ($\Delta T_1$) and a second temperature difference ($\Delta T_2$). Generating a flow control signal, for controlling the flow of the first medium into the heat exchanger, based on the first temperature difference ($\Delta T_1$), the second temperature difference ($\Delta T_2$) and the first temperature value $T_1$ and sending
(Continued)

the flow control signal to a regulator device for controlling the flow of the first medium in the heat exchanger.

16 Claims, 6 Drawing Sheets

(51) Int. Cl.
*F28F 27/02* (2006.01)
*F01K 13/00* (2006.01)
*F28D 21/00* (2006.01)
*F25B 39/02* (2006.01)

(52) U.S. Cl.
CPC ..... *F25B 39/02* (2013.01); *F25B 2600/21* (2013.01); *F25B 2700/21172* (2013.01); *F25B 2700/21173* (2013.01); *F25B 2700/21175* (2013.01); *F28D 2021/0064* (2013.01); *F28D 2021/0071* (2013.01)

(58) Field of Classification Search
CPC .. F25B 2700/21173; F25B 2700/21175; F28D 9/005; F28D 2021/0064; F28D 2021/0071
See application file for complete search history.

(56) References Cited

U.S. PATENT DOCUMENTS 7,059,143 B1 * 6/2006 Zugibe ..... F25B 43/02 62/192
7,086,240 B1 * 8/2006 Zugibe ..... F24F 11/62 62/114
7,481,060 B2 * 1/2009 Haertel ..... F02C 7/143 60/39.3
7,533,536 B1 * 5/2009 Zugibe ..... F24F 11/62 62/127
7,599,759 B2 * 10/2009 Zugibe ..... F25B 49/02 700/275
7,805,952 B1 * 10/2010 Zugibe ..... G05B 13/041 62/84
7,992,398 B2 * 8/2011 Tiranno ..... F25B 41/22 62/225
8,046,107 B2 * 10/2011 Zugibe ..... F25B 49/02 700/275
8,327,653 B1 * 12/2012 Zugibe ..... F25B 43/02 62/114
8,683,801 B2 * 4/2014 Ernst ..... F01K 23/065 60/615
8,783,032 B2 * 7/2014 Gartner ..... F01K 23/065 60/614
10,041,713 B1 * 8/2018 Zugibe ..... F24F 11/30
10,488,089 B2 * 11/2019 Kester ..... F25B 39/00
10,508,569 B2 * 12/2019 Adachi ..... F01K 13/02
2002/0197664 A1 * 12/2002 Lamare ..... B01J 19/0053 435/41
2006/0075771 A1 * 4/2006 Tracey, Jr. ..... F25B 49/005 62/506
2007/0256432 A1 * 11/2007 Zugibe ..... F25B 49/02 62/115
2008/0264081 A1 * 10/2008 Crowell ..... F02M 26/47 62/132
2010/0010681 A1 * 1/2010 Zugibe ..... F25B 43/02 700/282
2010/0011793 A1 * 1/2010 Tiranno ..... F25B 41/22 62/225
2010/0307155 A1 12/2010 Kasuya et al.
2012/0042650 A1 * 2/2012 Ernst ..... F01K 13/02 60/615
2013/0067910 A1 3/2013 Ishiguro et al.
2016/0076405 A1 3/2016 Hashimoto et al.
2016/0252310 A1 9/2016 Butzke et al.
2017/0138645 A1 * 5/2017 Sakima ..... F25B 41/20
2019/0203999 A1 * 7/2019 Kulankara ..... F25B 49/027
2021/0215414 A1 * 7/2021 Hu ..... B60H 1/00907
2021/0348834 A1 * 11/2021 Kaemingk ..... F25D 21/006

FOREIGN PATENT DOCUMENTS

KR 20140029261 A 3/2014
WO 2017218317 A1 12/2017

* cited by examiner

METHOD AND CONTROLLER FOR PREVENTING FORMATION OF DROPLETS IN A HEAT EXCHANGER

CROSS-REFERENCE

This application is the U.S. National Stage of International Application No. PCT/SE2019/051263, filed 10 Dec. 2019, which claims priority to Swedish Application No. SE1851592-4, filed 14 Dec. 2018.

TECHNICAL FIELD

The present invention relates generally to a method and controller for preventing formation of droplets in a heat exchanger, and more specifically to controlling the flow of a first medium in the heat exchanger. The present invention also relates to a computer program and a computer program product for performing the method.

BACKGROUND OF INVENTION

In power plants that are run by thermodynamic power cycles, such as a Rankine cycle, a Kalina cycle, a Carbon Carrier cycle and/or a Carnot cycle, a turbine is an essential element for generating power. A liquid is heated until it is converted in to dry gas which enters the turbine to perform work. Typically, the liquid is heated in a heat exchanger to produce dry gas, which exits the heat exchanger from an outlet port and is fed to the turbine.

One problem when heating the liquid into gas is that the gas is not totally dry, i.e. there may be liquid droplets in the gas. The momentum of fast moving liquid droplets exiting from a heat exchanger damages turbine blades and shortens the life span of the turbine. The turbine is typically the most expensive part of the power plant and if the life span of the turbine could be extended, costs for repairing or replacing turbine blades or turbines could be saved. A similar problem occurs with compressors that are coupled to heat exchangers, i.e. also here liquid droplets may damage the compressor. Consequently, there is also a need of eliminating the cost of repairing or replacing compressors.

EP2674697 relates to an evaporator system for better control and distribution of a supply of a cooling agent, between fluid passages in order to improve the efficiency of a plate heat exchanger independent of the prevailing running condition. The system comprises a sensor arrangement with temperature and pressure sensors for detecting the presence of liquid content in the evaporated fluid. The pressure sensor and temperature sensor are arranged between an outlet of the evaporator and an inlet of a compressor. The evaporator system further comprises an expansion valve, having the function of expanding cooling agent from a high to a low pressure side, and to fine tuning the flow. The expansion valve may be operated by a controller based on signals received from the pressure sensor and the temperature sensor.

Moreover, in some other prior art systems, there is a device for separating droplets from the gas which is led into the turbine. Such a droplet separator is positioned between the outlet of a first medium (i.e. working medium) and the turbine. The problem with droplet separators is that they are bulky and take up space in the system. There is also a cost aspect, which makes such a system more expensive. Thus, there is a need for a system which is both space and cost effective.

Consequently, in view of the above, there is a need for a controller and method for preventing formation of droplets in a heat exchanger which is more efficient and accurate, and which is adapted to be used together with turbines.

SUMMARY OF INVENTION

An object of the present invention is to provide an efficient method for preventing formation of droplets in a heat exchanger, especially for a heat exchanger used as a boiler.

According to an aspect of the present invention this object is accomplished by a method of preventing formation of droplets in a heat exchanger, in which heat exchanger a second medium transfers heat to a first medium and the method is performed by a controller. In the method the controller receives

- a first temperature value from a first temperature unit, of a temperature at a first position of the first medium exiting the heat exchanger,
- a pressure value, from a pressure sensor unit, of a pressure of the first medium exiting the heat exchanger,
- a second temperature value from a second temperature unit, of a temperature of the second medium entering the heat exchanger and
- a third temperature value from a third temperature unit, of a temperature of the second medium exiting the heat exchanger.

The method performed in the controller then,

- calculates a boiling point temperature value based on the received pressure value and heat exchanger parameters,
- determines a first temperature difference between the second temperature value and the first temperature value and
- determines a second temperature difference between the third temperature value and the boiling point temperature value.

Thereafter the controller generates a flow control signal, for controlling the flow of the first medium into the heat exchanger, based on the first temperature difference, the second temperature difference and the first temperature value and sends the flow control signal to a regulator device for controlling the flow of the first medium in the heat exchanger.

In an exemplary embodiment the flow control signal may be generated such that the first temperature difference and the second temperature difference are inversely proportional, and the first temperature value is directly proportional to the flow of the first medium in the heat exchanger. Especially, wherein the first temperature difference and the second temperature difference are inversely proportional in a range of 0 to 6° C. and the first temperature value is directly proportional in a range of 70-115° C. to the flow of the first medium in the heat exchanger.

In yet another exemplary embodiment of the method the controller receives a fourth temperature value, from the first temperature unit, of a temperature at a second position of the first medium exiting the heat exchanger, and the step of determining the first temperature difference further comprises determining the temperature difference between the second temperature value and either one the first temperature value and the fourth temperature value.

In a further embodiment the heat exchanger parameters comprise at least one of the following parameters: type of medium used as first medium, type of medium used as second medium, pressure(s) and flows in the system, ambient temperature, selected overheating temperature, differential temperature of the second medium between an inlet port an and outlet port of the heat exchanger.

Another object of the present invention is to provide a controller for efficiently preventing formation of droplets in a heat exchanger, especially for a heat exchanger used as a boiler.

According to another aspect of the present invention this object is accomplished by a controller for preventing formation of droplets in a heat exchanger, in which a second medium transfers heat to a first medium. The controller comprises a processor and a non-transitory computer-readable medium, configured to store instructions, which when executed by the processor, causes the controller to receive

- a first temperature value from a first temperature unit, of a temperature at a first position of the first medium exiting the heat exchanger,
- a pressure value, from a pressure sensor unit, of a pressure of the first medium exiting the heat exchanger,
- a second temperature value, from a second temperature unit, of a temperature of the second medium entering the heat exchanger, and
- a third temperature value, from a third temperature unit, of a temperature of the second medium exiting the heat exchanger.

The controller is further caused to

- calculate a boiling point temperature value based on the pressure value and heat exchanger parameters,
- determine a first temperature difference between the second temperature value and the first temperature value and
- determine a second temperature difference between the third temperature value and the boiling point temperature value.

Furthermore, the controller is caused too generate a flow control signal, for controlling the flow of the first medium into the heat exchanger, based on the first temperature difference, the second temperature difference and the first temperature value and send the flow control signal to a regulator device for controlling the flow of the first medium in the heat exchanger.

In an exemplary embodiment the controller is further caused to generate the flow control signal such that the first temperature difference and the second temperature difference are inversely proportional, and the first temperature value is directly proportional to the flow of the first medium in the heat exchanger. Especially, wherein the first temperature difference and the second temperature difference are inversely proportional in a range of 0 to 6° C. and the first temperature value is directly proportional in a range of 70-115° C. to the flow of the first medium in the heat exchanger.

In another exemplary embodiment the controller is further caused to receive a fourth temperature value, from the first temperature unit, of a temperature at a second position of the first medium exiting the heat exchanger and determine the first temperature difference as the temperature difference between the second temperature value and either one the first temperature value and the fourth temperature value.

In yet another exemplary embodiment the controller is further caused to calculate the boiling point temperature value based on at least one of the following heat exchanger parameters: type of medium used as first medium, type of medium used as second medium, pressure(s) and flows in the system, ambient temperature, selected overheating temperature, differential temperature of the second medium between an inlet port and outlet port of the heat exchanger.

According to further aspects of the present invention there is also provided a computer program comprising computer program code, which is adapted, if executed on a processor, to implement the above described method. Furthermore, there is provided a computer program product comprising a computer readable storage medium, the computer readable storage medium having the computer program mentioned above stored thereon.

One advantage with the method of the present invention is that flow of the first medium is controllable much closer to a desired flow curve, since the input for generating the flow control signal is based on three separate parts namely the first temperature difference, the second temperature difference and the first temperature value which are added together in controller. This in turn makes it possible to increase the energy efficiency of heat exchanger system and also reduce the wear of the turbine blades used to generate the energy and thereby increase the life span thereof.

DESCRIPTION

Figure 1:
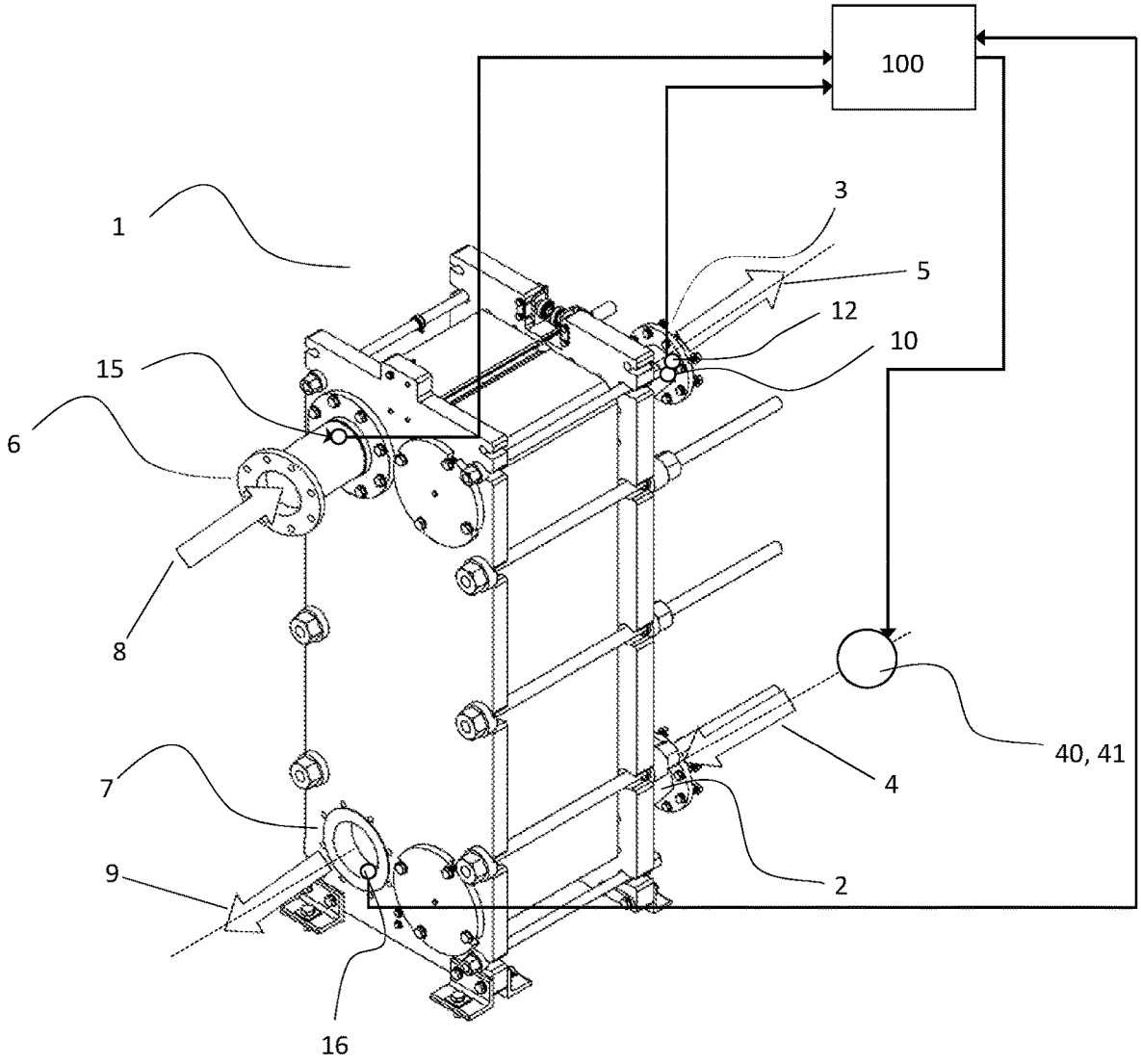
FIG. 1 shows a heat exchanger system with a heat exchanger, a controller and a regulator device for controlling the flow in a first medium.
Figure 2A:
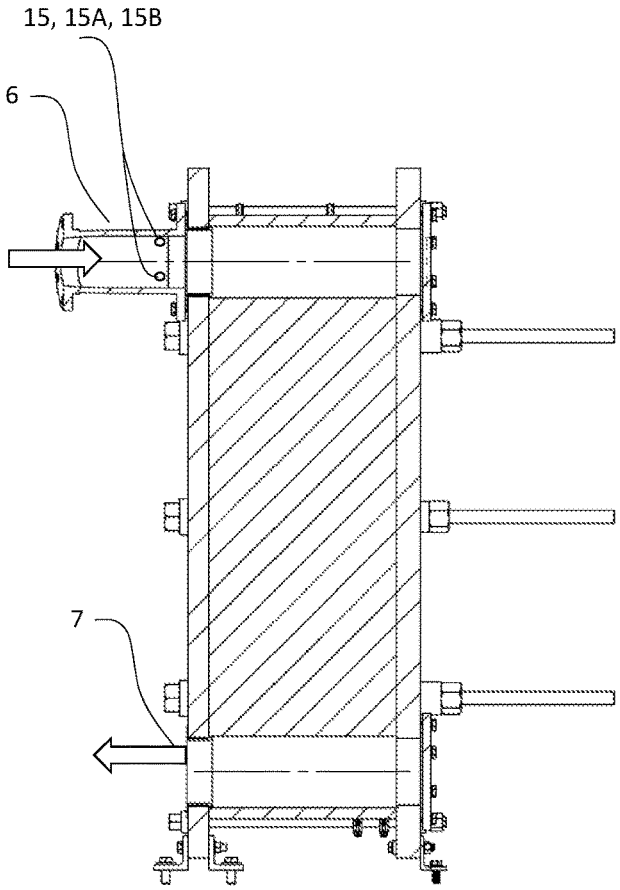
FIGS. 2*a* and 2*b* are cross-sectional side views of the heat exchanger in FIG. 1.
Figure 2B:
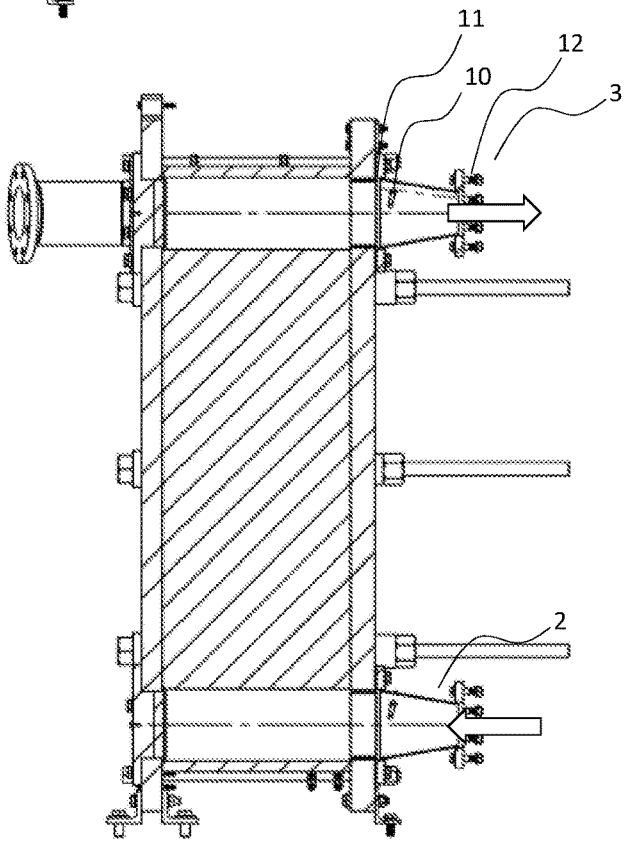

The present invention generally relates to controlling a flow in a heat exchanger, such that the heat exchanger system becomes more energy efficient. FIG. 1 shows such a heat exchanger system comprising a heat exchanger 1, a controller 100 and a regulator device 40, 41 for controlling the flow in a first medium. In FIGS. 2*a* and 2*b* the heat exchanger 1 in FIG. 1 is shown as cross-sectional side views. In the heat exchanger 1 a second medium transfers heat to the first medium. The heat exchanger 1 comprises an inlet port 2 and an outlet port 3 for the first medium, as well as an inlet port 6 and an outlet port 7 for the second medium. In FIG. 1 arrows 4 and 5 indicate the flow direction of the first medium entering and exiting the heat exchanger 1, while arrows 8 and 9 indicate the flow direction of the second medium entering and exiting the heat exchanger 1. The first medium is in context of the present disclosure referred to as the medium to be heated while the second medium is referred to as the medium which transfers heat to the first medium. The first medium may also be referred as the working medium.

The first medium and the second medium may be selected from the following groups water, alcohols (such as methanol, ethanol, isopropanol and/or butanol), ketones (such as acetone and/or methyl ethyl ketone), amines, paraffins (such as pentane and hexane) and/or ammonia. In an exemplary embodiment the first medium and the second medium are selected differently, such that the boiling point of the first medium is lower than the boiling point of the second medium. In a preferred exemplary embodiment, the first medium comprises acetone and is heated by the second medium which comprises water.

The heat exchanger 1 further comprises a first temperature sensor unit 10, a second temperature sensor unit 15, a third temperature sensor unit 16 and a pressure sensor unit 12. The first temperature pressure unit 10 is arranged to measure the temperature and the pressure sensor unit 12 is arranged to measure the pressure of the first medium exiting the heat exchanger 1 at the outlet port 3. The second temperature sensor unit 15 is arranged to measure the temperature of the second medium when entering the heat exchanger 1 at the inlet port 6. The third temperature sensor unit 16 is arranged to measure the temperature of the second medium when exiting the heat exchanger 1 at the outlet port 7. All these measured temperature values and the measured pressure value are used when generating a flow control signal to control the flow of the first medium in the heat exchanger 1, which will be described in more detail below.

Turning now to FIGS. 3*a-e* the arrangement and configuration of the first temperature unit 10 in the heat exchanger will be described in more detail. As mentioned above the first temperature unit 10 is arranged at the outlet port 3 where the first medium exists the heat exchanger 1. The first temperature sensor unit 10 may comprise one or more temperature sensors 10A, 10B distributed at different positions of the outlet port 3 of the heat exchanger 1. Temperature sensor 10A is arranged at a first position and temperature sensor 10 B is arranged at a second position. In an exemplary embodiment the temperature sensors 10A, 10B of the first temperature unit 10 are resistance temperature detectors, such as a platinum resistance thermometer with a nominal resistance of 10-1000 ohms at 0° C.

FIGS. 3*a-e* illustrate different possible positions for the temperature sensors 10A, 10B of the temperature sensor array 1. Measuring the temperature at different positions with different temperature sensor 10A, 10B may further increase the accuracy when generating the flow control signal for controlling the flow of the first medium in the heat exchanger 1. The temperature sensors 10A, 10B may for example be arranged at a circumferential position 0-360° within the preferably circular heat exchanger outlet port 3 of the first medium. The temperature sensors 10A, 10B of the first temperature sensor unit 10 are preferably arranged at a distance from the walls of the outlet port 3. The sensors 10A, 10B will then measure a more accurate temperature, since the temperature of the surroundings will not have an impact on the measured temperature. Although it has been illustrated that the outlet port 3 has a conical shape in FIGS. 3*a-e*, the outlet port 3 may have other shapes such as cylindrical shape.

Figure 3A:
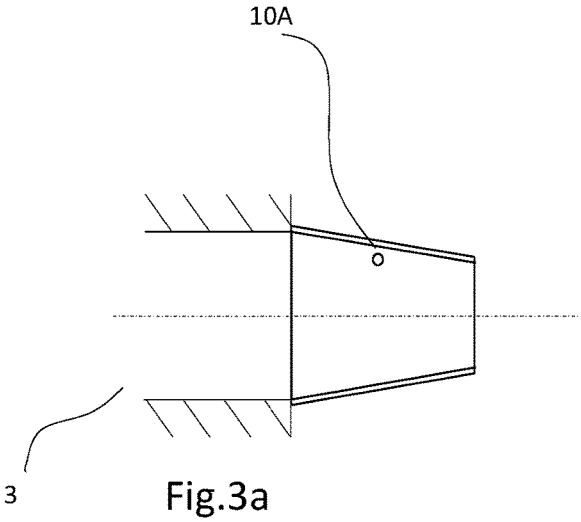
FIGS. 3*a-e* are detailed cross-sectional views of an outlet port of the first medium of the heat exchanger in FIG. 1 and illustrate different possible positions for sensors of a first temperature unit.

In FIG. 3*a*, the first temperature sensor unit 10 only comprises one temperature sensor 10A and is arranged at a top position, i.e. at 0°. The top position may also be referred to as the position furthest away in a direction opposite the gravitational field vector.

Figure 3B:
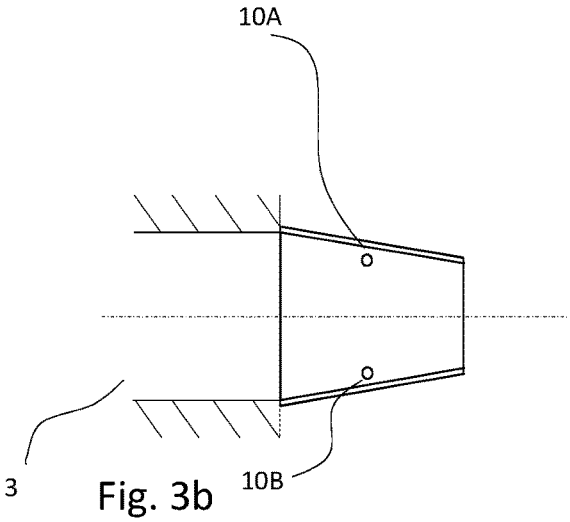

In FIG. 3*b*, the first temperature sensor unit 10 comprises two temperature sensors 10A, 10B which are arranged opposite of each other at a top and a bottom position at a circumferential position of 0° and 180°. It is of course also possible to place the temperature sensors 10A, 10B at an angle of +/−45° within said circumferential position and/or at any angle within said circumferential position. The angle is chosen depending on the flow through the outlet port 3 of the first medium, thus where the droplets are gathered due to potential turbulence.

Figure 3C:
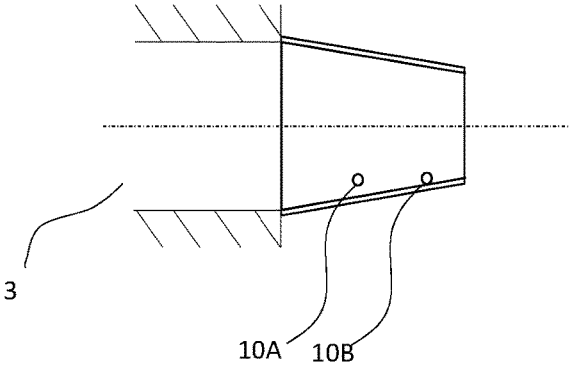

FIG. 3*c* shows an outlet 3 with a first temperature sensor unit 10 comprising two temperature sensors 10A, 10B arranged at a bottom position of the outlet 3.

Figure 3D:
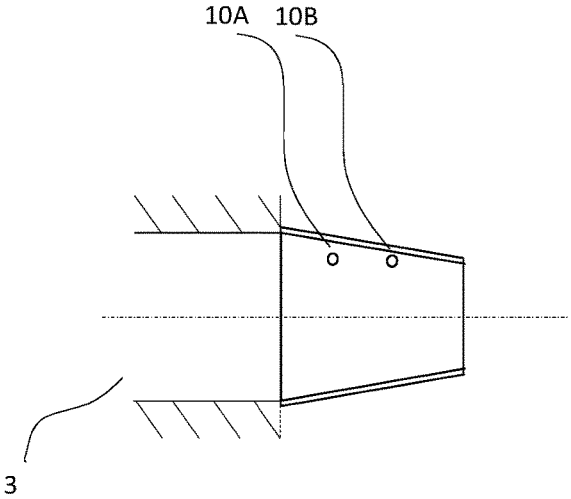

In FIG. 3*d* the first temperature sensor unit 10 comprises two temperature sensors 10A, 10B arranged at a top position of the outlet 3.

Figure 3E:
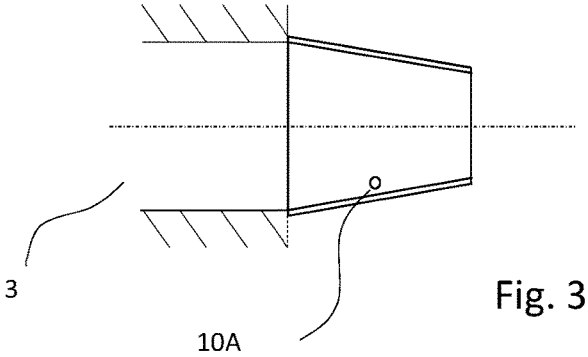

In FIG. 3*e*, the first temperature sensor unit 10 only comprises one temperature sensor 10A and is arranged at a bottom position, i.e. at 180°. The top position may also be referred to as the position closest to the gravitational field.

Figure 4A:
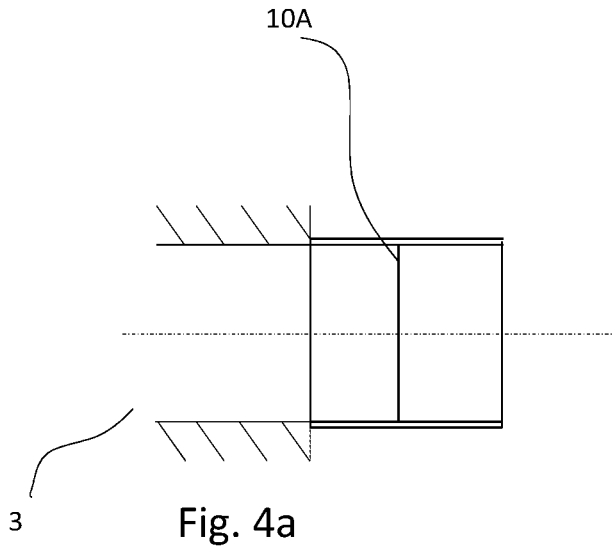
FIGS. 4*a* and 4*b* are cross-sectional views of the outlet port of the first medium of the heat exchanger in FIG. 1 and illustrate different possible positions of temperature measuring wire(s) of the first temperature unit.
Figure 4C:
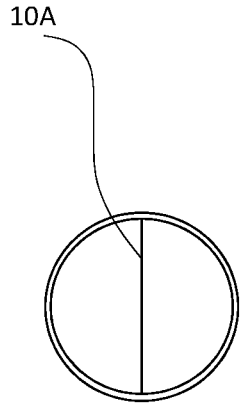
FIGS. 4*c-f* are views of the outlet port of the first medium looking into the outlet port via the opening of said port and illustrate different possible configurations of temperature measuring wires.
Figure 4B:
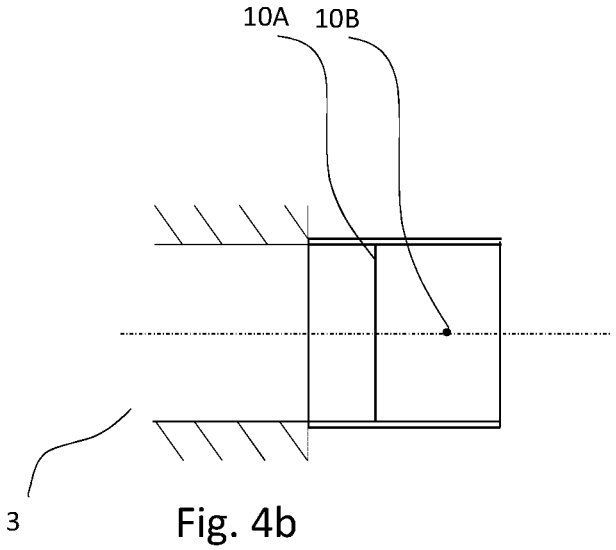
Figure 4E:
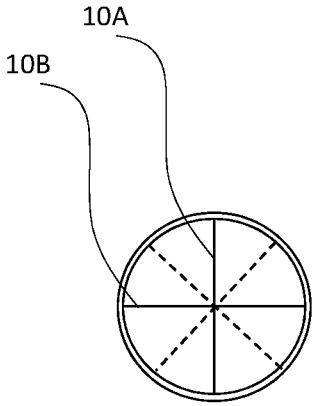
Figure 4D:
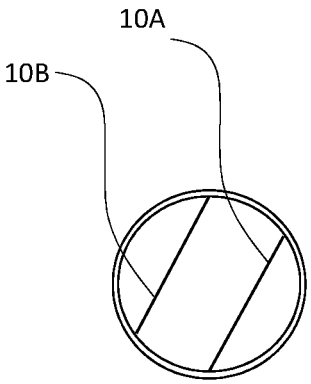
Figure 4F:
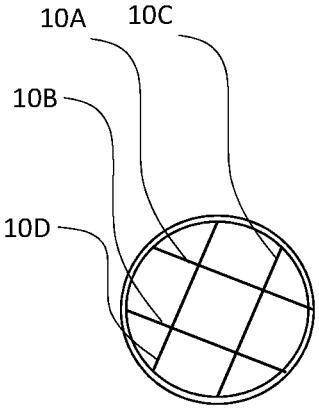

As understood by a person skilled in the art there are a wide variety of temperature sensors that may be used to measure the temperature at the outlet port 3 of the first medium in a heat exchanger 1. FIGS. 4*a-f* show examples where measuring wires are used as temperature sensors. In one exemplary embodiment, shown in FIG. 4*a* and FIG. 4*c*, a single temperature measuring wire 10A is used to measure the temperature. In other exemplary embodiments two temperature measuring wires 10A, 10B may be arranged at a distance from each other. The measuring wires may or may not intersect each other. In the exemplary embodiment of FIG. 4*d* two temperature measuring wires 10A, 10B are configured in parallel with respect to each other and in the exemplary embodiment of FIG. 4*b* and FIG. 4*e* two temperature measuring wires 10A, 10B are configured perpendicular with respect to each other. In the exemplary embodiment with two perpendicular temperature measuring wires 10A, 10B the temperature measuring wires 10A, 10B may be configured at any circumferential position 0-360° at the outlet 3 of the first medium. This is illustrated in FIG. 4*e* in which the perpendicular temperature measuring wires 10A, 10B are configured in two different circumferential positions at outlet port 3 of the first medium, wherein one configuration is shown with dashed lines while in the other configuration is shown with full lines. In a further exemplary embodiment illustrated in FIG. 4*f*, there may be at least four temperature measuring wires 10A, 10B 10C and 10D, of which two of the wires, 10A, 10B are configured in parallel with respect to each other, and the other two wires, 10C, 10D, are configured in parallel with each other as well as configured perpendicular or at any other angle with respect to the other two wires 10A, 10B.

It should be noted that also the arrangement and configuration of temperature sensors of the second temperature unit 15 at the inlet port 6 of the second medium, of the third temperature unit 16 at the outlet port 7 of the second medium and of the pressure sensor unit 12 at the outlet port 3 of the first medium may be made in a similar way as for the temperature sensors of the first temperature unit 10. Given the thorough description of the arrangement and configuration of temperature sensors of the first temperature unit 10 above, this is readily accomplished by a person skilled in the art and will therefore not be repeated here. An example of the arrangement of the temperature sensors 15A, 15B of the second temperature unit 15 at the inlet 6 of the second medium is shown in FIG. 2*a*.

The heat exchanger 1 is arranged and/or adapted to vaporize the first medium and may be configured as a boiler and is preferably selected as one of a plate heat exchanger, plate-and-shell heat exchanger, plate-fin heat exchanger, shell-and-tube heat exchangers, or variants thereof.

Figure 5:
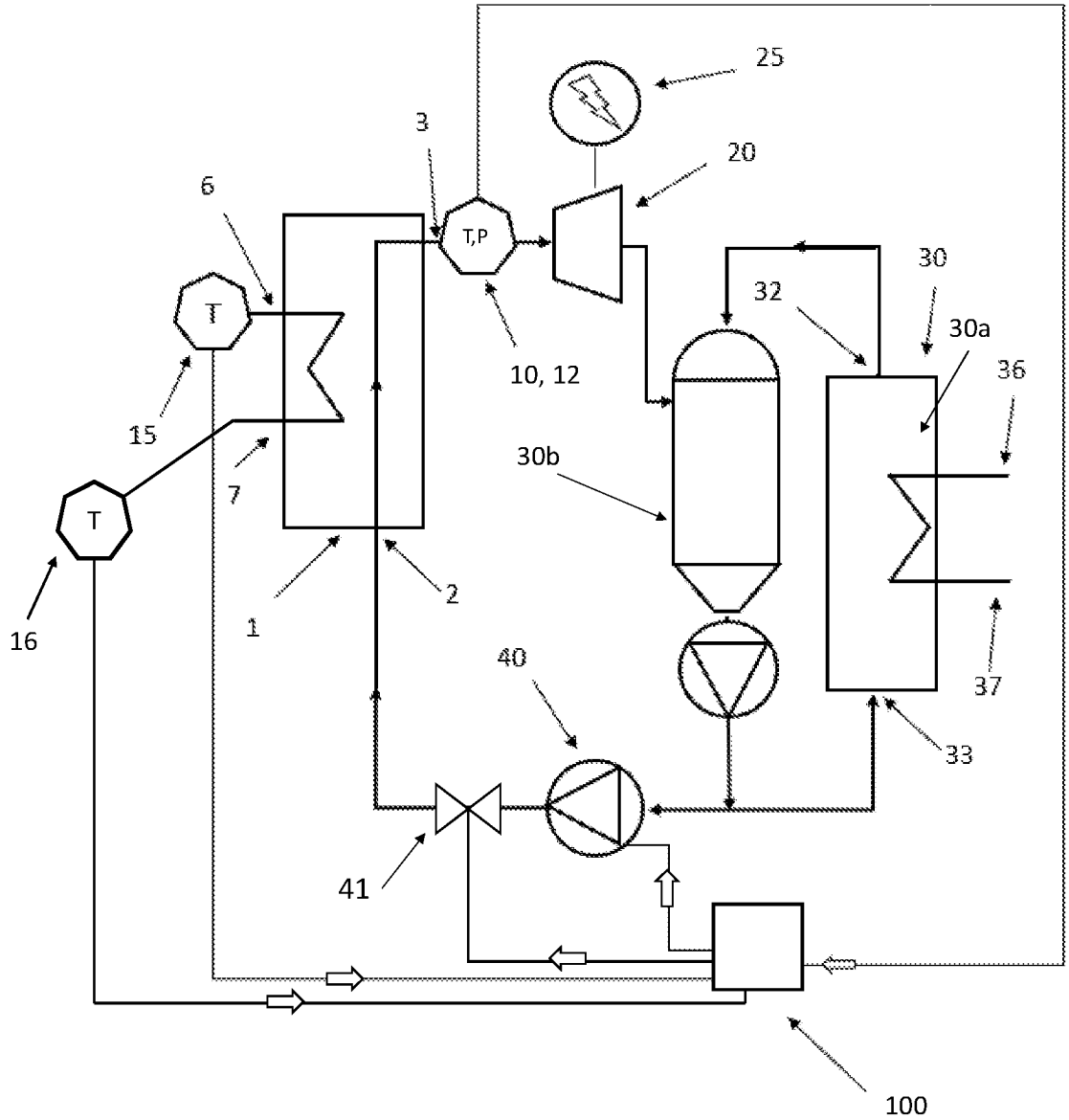
FIG. 5 illustrates a waste heat power generator in which the present invention may be utilized.

Turning now to FIG. 5 an exemplary embodiment will be described in which the heat exchanger 1 is part of a waste heat power generator. The waste heat power generator is a closed loop thermodynamic system, preferably an Organic Rankine Cycle, ORC, system. The ORC system comprises a circulating working medium, i.e. the first medium, circulating through a turbine 20 coupled to a power-generating device 25 which is configured to generate electric power while expanding the gas which is produced in a first heat exchanger 1 by boiling and overheating the working medium. The boiling and overheating is accomplished by guiding the hot heat transferring second medium through the first heat exchanger 1. The gas which has passed through the turbine 20 and power-generating device 25 is condensed in a condenser 30 by cooling the gas with a cooling medium. The condenser 30 comprises a second heat exchanger 30*a* arranged to cool a stream of working medium and a separate condenser tank 30*b* to condense the working medium. The second heat exchanger 30*a* has an inlet 36 and an outlet 37 for the cooling medium as well as an inlet 33 and an outlet 32 for the working medium, i.e. an inlet 32 for the gas entering the condenser 30 and an outlet 33 for the condensate.

The regulator device 40, 41 conveys the working medium condensed at the condenser 30 to the first heat exchanger 1. The working medium (i.e. the first medium) enters the first heat exchanger 1 via the inlet port 2 of the first medium and exits through the outlet port 3 of the first medium in form of gas. The second medium enters the first heat exchanger 1 via the inlet port 6 of the second medium and then exits via the outlet port 7 of the second medium.

The regulator device 40, 41 is configured for controlling the flow of the first medium into the heat exchanger 1 through the first medium inlet port 2. The regulator device may comprise a pump 40, a valve 41 and/or an injector or any combination of such devices. Thus, when the controller 100 sends a flow control signal to the regulator device 40, 41 for controlling the flow of the first medium the regulator device 40, 41 may reduce or increase the area at the inlet port 2 of the first medium, reduce or increase the rotational speed of the pump 40 or the injector, or both alternatives.

Figure 6:
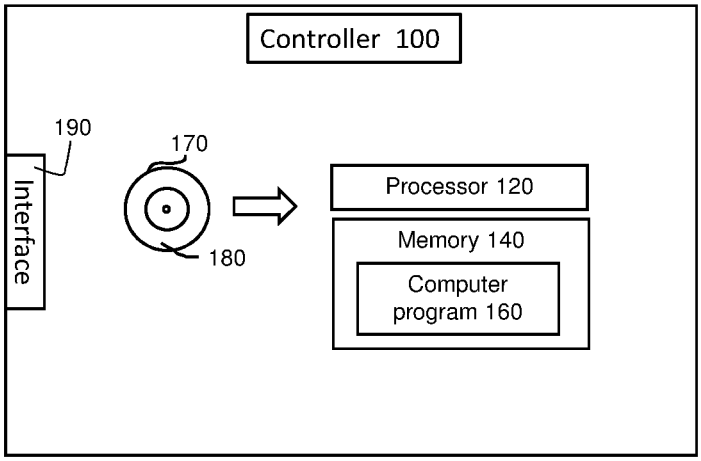
FIG. 6 shows a schematic view of controller for controlling the flow of a first medium in the heat exchanger.

Turning now to FIG. 6 the controller 100 for controlling the flow of the first medium will be closer described. The controller 100 is configured to and is operable for performing the method to be described in conjunction with FIG. 7. The controller 100 comprises a processor 120 and a memory 140. In context of the present application the term processor 120 should be interpreted broadly as processing circuitry, which may comprise one or more programmable processors, application-specific integrated circuits, field programmable gate arrays or combinations of these (not shown) adapted to execute instructions. The memory 140 contains instructions executable by said processing circuitry, whereby the controller 100 is operative to receive a first temperature value $T_1$, from the first temperature unit 10, a pressure value P, from the pressure sensor unit 12, a second temperature value $T_2$, from the second temperature unit 15 and a third temperature value $T_3$, from the third temperature unit 16, calculate a boiling point temperature value $T_B$ based on the pressure value P and heat exchanger parameters, determine a first temperature difference $\Delta T_1$ between the second temperature value $T_2$ and the first temperature value $T_1$ and a second temperature difference $\Delta T_2$ between the third temperature value $T_3$ and the boiling point temperature value $T_1$, generate the flow control signal, for controlling the flow of the first medium into the heat exchanger 1, based on the first temperature difference $\Delta T_1$, the second temperature difference $\Delta T_2$ and the first temperature value $T_1$ and send the flow control signal to the regulator device for controlling the flow of the first medium in the heat exchanger.

According to other embodiments, the controller 100 may further comprise an interface 190, which may be considered to comprise conventional means for communication with other units or devices. The instructions executable by the processor 120 may be arranged as a computer program 160 stored e.g. in the memory 140.

The computer program 160 may comprise computer readable code means, which when run in the controller 100 causes the controller 100 to perform the steps described in method below. The computer program 160 may be carried by a computer program product connectable to the processor 120. The computer program product may be the memory 140. The memory 140 may be realized as for example a RAM (Random-access memory), ROM (Read-Only Memory) or an EEPROM (Electrical Erasable Programmable ROM). Further, the computer program may be carried by a separate computer-readable medium 170, such as a CD, DVD or flash memory, from which the program could be downloaded into the memory 140. Alternatively, the computer program may be stored on a server or any other entity connected or connectable to the controller 100 via the interface 190. The computer program may then be downloaded from the server into the memory 140.

The controller 100 may in an exemplary embodiment further be operative to generate the flow control signal such that the first temperature difference $T_2-T_1=\Delta T_1$ is inversely proportional to the flow of the first medium in the heat exchanger 1 within a range of 0-6° C. With other words, if the temperature difference $\Delta T_1$ is within said range an increase of the temperature difference $\Delta T_1$ will result in a decrease of the flow of the first medium into the heat exchanger 1. In a similar way the controller 100 is operative to generate the flow control signal such that second temperature difference $T_3-T_B=\Delta T_2$ is inversely proportional to the flow of the first medium in the heat exchanger 1 within a range of 0-6° C. Thus, if the temperature difference $\Delta T_2$ is within said range an increase of the temperature difference $\Delta T_2$ will result in a decrease of the flow of the first medium into the heat exchanger 1.

Furthermore, the controller 100 is operative to generate the flow control signal such that the first temperature value $T_1$ is directly proportional to the flow of the first medium in the heat exchanger 1, for 70° C.$<T_1<$115° C. Thus, an increase of the temperature $T_1$ will increase the flow of the first medium into the heat exchanger 1.

Thus, there are three different contributions when the controller 100 generates the flow control signal, namely the temperature difference $\Delta T_1$, the temperature difference $\Delta T_2$ and the first temperature value $T_1$, which are added together.

In an exemplary embodiment the controller 100 is further caused to receive a fourth temperature value $T_4$ from the first temperature unit 10. The fourth temperature value is used to increase the accuracy of the temperature measurement at the outlet 3 for the first medium. In this exemplary embodiment the first temperature difference $\Delta T_1$ determined as the temperature difference between the second temperature value $T_2$ and either one the first temperature value $T_1$ and the fourth temperature value $T_4$.

The controller 100 is further caused to calculate the boiling point temperature value $T_B$ based on at least one of the following heat exchanger parameters: type of medium used as first medium, type of medium used as second medium, pressure(s) and flows in the system, ambient temperature, selected overheating temperature $\Delta T_{overheat}$, differential temperature of the second medium between an inlet port 6 and an outlet port 7 of the heat exchanger 1.

In an exemplary embodiment the calculation of the boiling point temperature value is calculated using the Antoine equation:

$$\log_{10} p = A - \frac{B}{C+T},$$

where p is the vapour pressure, T the temperature and A, B and C are specific heat exchanger parameters.

In an exemplary embodiment the controller 100 is a Proportional Integral Derivative, PID, regulator, a Programmable Logic Controller, PLC, a personal computer or any other suitable control system.

Figure 7:
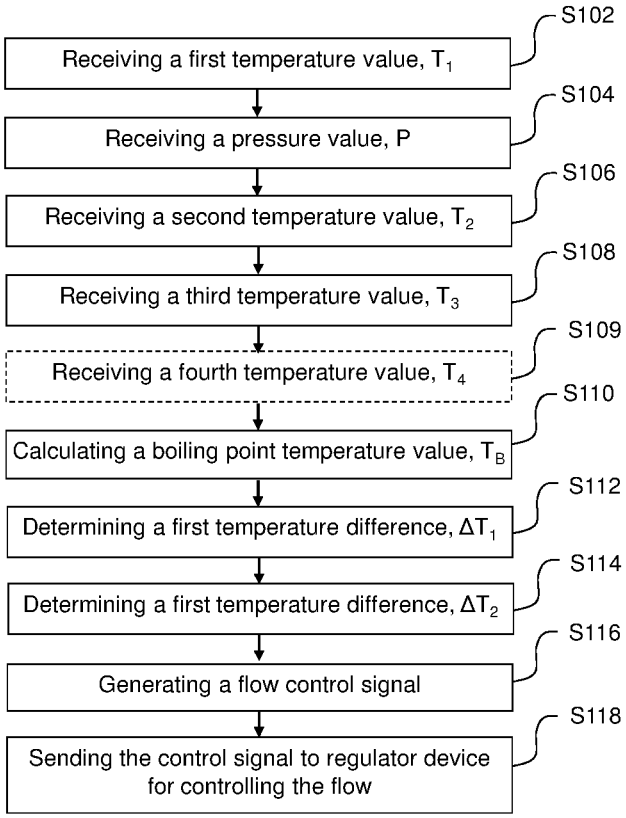
FIG. 7 is a flow chart showing the method for preventing formation of droplets.

Turning now to FIG. 7 the method according to the present invention will be closer described by means of a flow chart. As mentioned above, the method prevents formation of droplets in the heat exchanger 1. In the heat exchanger 1 the second medium transfers heat to the first medium and the method is performed by the controller 100 described above. Thus, features in common with the method and the controller will only be briefly described a second time.

In step S102 the controller 100 receives the first temperature value $T_1$ from a first temperature unit 10. The first temperature value $T_1$ is measured at a first position of the first medium exiting the heat exchanger. In step S104 the controller 100 receives a pressure value P from a pressure sensor unit 12. Also, the pressure value P is measured at a position where the first medium exits the heat exchanger. In step S106 a second temperature value $T_2$ is received by the controller 100 from the second temperature unit, which second temperature value $T_2$ measured at a position where the second medium enters the heat exchanger. Furthermore, in step S108 a third temperature value $T_3$ is received from the third temperature unit 16, which third temperature value is measured at a position where the second medium exits the heat exchanger. In an optional step S109, shown with dashed lines in FIG. 7, a fourth temperature value $T_4$ is received from the first temperature unit 10, which fourth temperature value $T_4$ is measured at a second position of the first medium exiting the heat exchanger 1.

After receiving all temperature values and pressure the controller 100 calculates, in step S110, a boiling point temperature value $T_B$ based on the pressure value P and heat exchanger parameters. The heat exchanger parameters may comprise at least one of the following parameters: type of medium used as first medium, type of medium used as second medium, pressure(s) and flows in the system, ambient temperature, selected overheating temperature $\Delta T_{overheat}$, differential temperature of the second medium between an inlet port 6 and an outlet port 7 of the heat exchanger 1.

This calculation may as mentioned above be performed using the Antoine equation. In step S112 the first temperature difference $\Delta T_1$ is determined between the second temperature value $T_2$ and the first temperature value $T_1$. If optional step S109 has been performed step S112 may instead determine the first temperature difference $\Delta T_1$ as the temperature difference between the second temperature value $T_2$ and either one the first temperature value $T_1$ and the fourth temperature value $T_4$. In step S114 a second temperature difference $\Delta T_2$ is determined between the third temperature value $T_3$ and the boiling point temperature value $T_B$.

The first temperature difference $\Delta T_1$, the second temperature difference $\Delta T_2$ and the first temperature value $T_1$ are the used for generating, in step S116, a flow control signal for controlling the flow of the first medium into the heat exchanger 1. Then in step S118 the controller 100 sends the flow control signal to the regulator device 40, 41 for controlling the flow of the first medium into the heat exchanger 1.

In an exemplary embodiment the flow control signal is generated such that the first temperature difference $\Delta T_1$ and the second temperature difference $\Delta T_2$ are inversely proportional within a range for $\Delta T_1$ and $\Delta T_2$ of 0-6° C. and such that the first temperature value $T_1$ is directly proportional, for $T_1$ between 70° C.-115° C., to the flow of the first medium in the heat exchanger 1.

Although the description above contains a plurality of specificities, these should not be construed as limiting the scope of the concept described herein but as merely providing illustrations of some exemplifying embodiments of the described concept. It will be appreciated that the scope of the presently described concept fully encompasses other embodiments which may become obvious to those skilled in the art, and that the scope of the presently described concept is accordingly not to be limited. Reference to an element in the singular is not intended to mean "one and only one" unless explicitly so stated, but rather "one or more." All structural and functional equivalents to the elements of the above-described embodiments that are known to those of ordinary skill in the art are expressly incorporated herein and are intended to be encompassed hereby. Moreover, it is not necessary for the controller or method to address each and every problem sought to be solved by the presently described concept, for it to be encompassed hereby. In the exemplary figures, a broken line generally signifies that the feature within the broken line is optional.

The invention claimed is:

1. A method of preventing formation of droplets in a heat exchanger, in which a second medium transfers heat to a first medium, said method being performed by a controller and comprising:

receiving a first temperature value ($T_1$), from a first temperature unit, of a temperature at a first position of the first medium exiting the heat exchanger, receiving a pressure value (P), from a pressure sensor unit, of a pressure of the first medium exiting the heat exchanger, receiving a second temperature value ($T_2$), from a second temperature unit, of a temperature of the second medium entering the heat exchanger, receiving a third temperature value ($T_3$), from a third temperature unit, of a temperature of the second medium exiting the heat exchanger, calculating a boiling point temperature value ($T_B$) based on the pressure value (P) and heat exchanger parameters, determining a first temperature difference ($\Delta T_1$) between the second temperature value ($T_2$) and the first temperature value ($T_1$), determining a second temperature difference ($\Delta T_2$) between the third temperature value ($T_3$) and the boiling point temperature value ($T_B$), generating a flow control signal, for controlling a flow of the first medium into the heat exchanger, based on the first temperature difference ($\Delta T_1$), the second temperature difference ($\Delta T_2$) and the first temperature value ($T_1$), and sending the flow control signal to a regulator device for controlling the flow of the first medium in the heat exchanger.

2. The method of claim 1, wherein the flow control signal is generated such that the first temperature difference ($\Delta T_1$) and the second temperature difference ($\Delta T_2$) are inversely proportional and the first temperature value ($T_1$) is directly proportional to the flow of the first medium in the heat exchanger.

3. The method of claim 2, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

4. The method of claim 1, further comprising:

receiving a fourth temperature value ($T_4$), from the first temperature unit, of a temperature at a second position of the first medium exiting the heat exchanger, wherein the determining of the first temperature difference ($\Delta T_1$) further comprises determining, as the first temperature difference ($\Delta T_1$), a temperature difference between the second temperature value ($T_2$) and either one the first temperature value ($T_1$) and the fourth temperature value ($T_4$).

5. The method of claim 4, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

6. The method of claim 1, wherein the heat exchanger parameters comprise at least one of the following parameters including: type of medium used as the first medium, type of medium used as the second medium, pressure(s) and flows in the heat exchanger, ambient temperature, a selected overheating temperature $\Delta T_{overheat}$, and a differential temperature of the second medium between an inlet port and an outlet port of the heat exchanger.

7. The method of claim 6, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

8. A controller for preventing formation of droplets in a heat exchanger, in which a second medium transfers heat to a first medium, the controller comprising a processor and memory, configured to store instructions, which when executed by the processor, cause the controller to:

receive a first temperature value ($T_1$), from a first temperature unit, of a temperature at a first position of the first medium exiting the heat exchanger, receive a pressure value (P), from a pressure sensor unit, of a pressure of the first medium exiting the heat exchanger, receive a second temperature value ($T_2$), from a second temperature unit, of a temperature of the second medium entering the heat exchanger, receive a third temperature value ($T_3$), from a third temperature unit, of a temperature of the second medium exiting the heat exchanger, calculate a boiling point temperature value ($T_B$) based on the pressure value (P) and heat exchanger parameters, determine a first temperature difference ($\Delta T_1$) between the second temperature value ($T_2$) and the first temperature value ($T_1$), determine a second temperature difference ($\Delta T_2$) between the third temperature value ($T_3$) and the boiling point temperature value ($T_B$), generate a flow control signal, for controlling a flow of the first medium into the heat exchanger, based on the first temperature difference ($\Delta T_1$), the second temperature difference ($\Delta T_2$) and the first temperature value ($T_1$), and send the flow control signal to a regulator device for controlling the flow of the first medium in the heat exchanger.

9. The controller of claim 8, wherein the controller is further caused to generate the flow control signal such that the first temperature difference ($\Delta T_1$) and the second temperature difference ($\Delta T_2$) are inversely proportional and the first temperature value ($T_1$) is directly proportional to the flow of the first medium in the heat exchanger.

10. The controller of claim 9, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

11. The controller of claim 8, wherein the controller is further caused to receive a fourth temperature value ($T_4$), from the first temperature unit, of a temperature at a second position of the first medium exiting the heat exchanger, and determine, as the first temperature difference ($\Delta T_1$), a temperature difference between the second temperature value ($T_2$) and either one the first temperature value ($T_1$) and the fourth temperature value ($T_4$).

12. The controller of claim 11, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

13. The controller of claim 8, wherein the controller is further caused to calculate the boiling point temperature value ($T_B$) based on at least one of the following heat exchanger parameters including: type of medium used as the first medium, type of medium used as the second medium, pressure(s) and flows in the heat exchanger, ambient temperature, a selected overheating temperature $\Delta T_{over\text{-}heat}$, and a differential temperature of the second medium between an inlet port and an outlet port of the heat exchanger.

14. The controller of claim 13, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

15. The controller of claim 8, wherein the first temperature difference ($\Delta T_1$) and the second temperature difference ($\Delta T_2$) are inversely proportional in a range of 0-6° C. and the first temperature value ($T_1$) is directly proportional in a range of 70-115° C. to the flow of the first medium in the heat exchanger.

16. A non-transitory computer readable recording medium having a computer program comprising computer program code recorded thereon, the computer program, when executed on a processor, causing the processor to implement the method according to claim 1.

* * * * *